US007380382B2

(12) United States Patent
Hansen

(10) Patent No.: US 7,380,382 B2
(45) Date of Patent: Jun. 3, 2008

(54) DRYWALL REPAIR PATCH

(75) Inventor: Daniel R. Hansen, Los Angeles, CA (US)

(73) Assignee: The Great Wall Patch Co., Inc. a California corporation, Los Angeles, CA (US)

( * ) Notice: Subject to any disclaimer, the term of this patent is extended or adjusted under 35 U.S.C. 154(b) by 240 days.

(21) Appl. No.: 10/842,681

(22) Filed: May 10, 2004

(65) Prior Publication Data

US 2005/0247011 A1 Nov. 10, 2005

(51) Int. Cl.
*B32B 35/00* (2006.01)
*E04G 23/02* (2006.01)

(52) U.S. Cl. ..... 52/514; 52/514.5; 156/94; 428/63

(58) Field of Classification Search ..... 52/514, 52/514.5, 746.1, 741.4, 741.41; 156/94; 428/63; 114/227, 229
See application file for complete search history.

(56) References Cited

U.S. PATENT DOCUMENTS 2,410,865 A * 11/1946 Brown ..... 106/648
3,043,298 A 7/1962 Brickman et al.
3,945,842 A 3/1976 Green
4,135,017 A 1/1979 Hoffmann, Sr.
4,353,510 A 10/1982 Damke et al.
4,381,769 A 5/1983 Prahl
4,620,407 A * 11/1986 Schmid ..... 52/745.09
4,632,790 A * 12/1986 Bernard ..... 264/36.2
4,707,391 A 11/1987 Hoffmann, Sr.
4,776,906 A * 10/1988 Bernard ..... 156/85
4,959,251 A * 9/1990 Owens et al. ..... 428/40.6
4,984,566 A 1/1991 Sekine et al.
5,075,149 A * 12/1991 Owens et al. ..... 428/138
5,269,861 A * 12/1993 Gilbreath ..... 156/98
5,298,099 A * 3/1994 Hoffmann, Sr. ..... 156/94

(Continued)

FOREIGN PATENT DOCUMENTS

CA 1300861 B 5/1992

OTHER PUBLICATIONS

DAP Wall Repair Patch Product Cover, 2 pages (no date).
E-Z Patch by Spray Tex product cover, 2 pages (no date).
Homax Wall Patch product cover, 2 pages (no date).

(Continued)

*Primary Examiner*—Robert Canfield
*Assistant Examiner*—Christine T Cajilig
(74) *Attorney, Agent, or Firm*—Townsend and Townsend and Crew, LLP

(57) ABSTRACT

A drywall repair patch comprises: a mesh sheet which carries a dry, pressure sensitive adhesive layer on at least one side thereof, and at least one layer of a dry, water hardenable cement product carried on a side of the mesh sheet. The mesh sheet is free of any rigid supporting plate. Further by this invention, water is applied to the water hardenable cement, typically after placement on the wall, followed by pushing a portion of the cement layer and mesh sheet into the hole being covered, without substantially breaking the adherence to the wall, to form a concave portion of the patch in the hole. After hardening, a second portion of water hardenable cement material is applied to form a smooth wall surface over the hole and drywall patch.

23 Claims, 4 Drawing Sheets

U.S. PATENT DOCUMENTS

| | | | | |
|---|---|---|---|---|
| 5,620,768 | A | 4/1997 | Hoffmann, Sr. | |
| 5,640,820 | A * | 6/1997 | Wood | 52/514 |
| 5,687,528 | A * | 11/1997 | Rouch | 52/514 |
| 5,925,204 | A * | 7/1999 | Hoffmann, Sr. | 156/98 |
| 6,071,833 | A * | 6/2000 | D'Alisa et al. | 442/42 |
| 6,162,525 | A * | 12/2000 | Amy | 428/119 |
| 6,231,949 | B1 * | 5/2001 | Hoffmann, Sr. | 428/139 |
| 6,607,621 | B1 * | 8/2003 | Swanson | 156/94 |
| 6,852,408 | B2 | 2/2005 | Hansen et al. | |
| 2003/0181114 | A1 | 9/2003 | Newton et al. | |

OTHER PUBLICATIONS

Hyde Tools Wet & Set product cover, 2 pages, 2003.

FibaTape Wall and Ceiling Repair Patch product cover, 2 pages (no date).

"Benefits with Lafarge Bandage plasters"; http://www.lafargeprestia.com/body_surgical_ bandage.html, 2 pages.

"Alban Plaster of Paris Bandage-Casting Material"; http://www.albanltd.com/products.html, 2 pages.

* cited by examiner

DRYWALL REPAIR PATCH

BACKGROUND OF THE INVENTION

It is common in the construction trade to have to create channels and access holes in drywall to insert data lines, run electrical wiring and to install pipes for plumbing. Repair patches are commercially available for repairing holes, or other defects, so that the holes or defects may be completely covered without a trace of its presence, after a plastering compound such as joint compound has been applied. However, there is no presently available system to efficiently and adequately repair the typical cut channels, which are generally at least 3 to 5 inches wide that run from a few feet to any length, that commonly need to be created by electricians, plumbers and others.

The current, most popular drywall patch has a fiberglass mesh material and a metal plate. The self adhesive mesh holds the metal drywall patch in position during repair, permitting a cement product such as quickset plaster (or joint compound) to be applied over it.

The metal plate provides an improvement over earlier patch designs, which did not have such a metal plate, providing strength and structure to the patch while plaster is being applied.

However, the drywall patch that carries the metal plate has certain disadvantages. Obviously, it is not flexible, and cannot be sold in a roll, where shaped pieces can be cut out and used, for example for the covering of channels that have been cut in drywall, using relatively long and narrow patches which may be especially cut for the job. A patch with a metal plate is generally of fixed shape, and is difficult to cut.

Another problem with the above patch which carries a metal plate is that the metal plate may pull away from the wall as the first application of plaster or joint compound is applied to cover and hide it, for finishing of the wall. This creates a raised surface that has to be feathered out with more joint compound, making it very difficult for the novice to make a professional looking repair. Also, when one does cut the metal plate to shape the metal patch, it cannot be cut easily without the use of tin snips, and even then warping of the edges of the metal plate can take place where it is cut.

Also, patches including fiberglass meshing that is comprised of a greater width than is typically used for conventional drywall tape without the metal plate have been used, but they have a problem that the plaster or other topping compound which is applied to the patch on the wall can pull the patch out of position as it is applied. This problem is especially compounded when such patches are used for repairing ceilings. A metal plate reduces this problem, but does not entirely eliminate it.

In accordance with this invention, a repair patch system is provided, which may be initially flexible before being wetted to activate the layer or layers of water hardenable cement product carried on it, and which may be cut to essentially any desired shape or size for use. Also, the patch system stays in place better as additional cement product is applied to the wall, to finish the project after the patch has been applied, particularly when it is treated in accordance with the method of this invention as described below.

DESCRIPTION OF THE INVENTION

In accordance with this invention, a drywall repair patch is provided, which comprises: a mesh sheet which carries a dry, pressure sensitive adhesive layer on one side thereof; and at least one layer of a dry, water hardenable cement product also carried on said mesh sheet, typically on the other side thereof, with the mesh sheet being free of any rigid supporting plate. The repair patch is at least about four inches both in length and width, unlike drywall tape used for taping drywall seams and cracks, which is typically about two inches wide, and cannot be effectively used for patching holes or channels, where substantial drywall material is missing.

The drywall repair patch of this invention carries both dry, pressure sensitive adhesive, and a water hardenable cement product layer such as a plaster and particularly a quickset plaster, of the type used in plaster bandages for medical cast forming, such as that disclosed in U.S. Pat. No. 3,945,842. The mesh sheet may comprise a fiberglass mesh, or an organic fiber mesh such as cotton fabric. Other equivalent mesh sheets or perforated sheets may also be utilized as may be appropriate. A removable paper or plastic release sheet may protect the pressure sensitive adhesive layer.

As stated, it is preferred for the cement product used in the repair patch of this invention to comprise a plaster which is a known and commercially available material used in flexible medical bandages and the like. A gypsum plaster or plaster of Paris may be used. Also, the patch of this invention may comprise part of a roll of patch material, comprising a plurality of connected repair patches, which may be separated along a line of perforation or the like if desired, or it may be a continuous material which is cut to any desired shape, permitting the cutting of long segments for the patching of cut channels in drywall. For example, the segments may have a length that is at least five times its width.

The rolled repair patch material may carry the removable liner as stated above, to keep the pressure sensitive adhesive layer from adhesively removing the attached cement product from adjacent coils of repair patch material. Furthermore, each side of the mesh sheet may carry one or more layers of the cement product used, such as the bandage plaster, with the dry, pressure sensitive contact adhesive layer being carried on the face of a plaster layer. A large variety of dry, pressure sensitive adhesives are commercially available for use with this invention, for example the dry adhesives which are currently used with respect to metal plate-carrying wall patches, such as the Homax® brand wall patch of the Homax Company of Bellingham, Wash. One type of dry, pressure sensitive adhesive which may be used is a rubber-based adhesive.

Thus, a wall patch is provided which carries both a water-hardenable cement product and a dry, pressure sensitive adhesive. The dry adhesive is used to secure the system to the wall, typically by manual pressure, in a reliable manner. The cement product is moistened to harden it on cure, typically after application of the patch to the wall, while there is a retention provided to the system by the dry adhesive. As stated, the dry, pressure sensitive adhesive may be carried on a layer of cement product, or it may be carried on one surface of the mesh and to an attached layer of cement product, optionally through the apertures in the mesh, when a second layer of cement product is not used. In either case, the wall patch can be retained in position as one moistens the cement product on the patch, to cause it to set into a rigid patch, covering the hole in the drywall, which may be a cut channel, or a hole of any other shape. Then, as is conventional, additional joint compound or the like is applied to smooth out the surface around the patch, to provide a professional looking drywall repair. The term "hole" is intended to include cut channels, and not to be limited by shape.

Further in accordance with this invention, a method is provided of applying a drywall patch to a hole in the drywall, which comprises the following steps:

One applies over the hole a mesh sheet of the drywall patch, which carries a dry, pressure sensitive adhesive layer on one side thereof, to adhere the mesh sheet to surfaces around the hole and to cover the hole. One then applies water to a layer of a dry, water hardenable cement material which is carried on the mesh sheet, and typically its outer surface, to obtain water permeation. A central portion of the wet, uncured plaster layer and the mesh sheet is then pressed into the hole, to form an indentation without substantially breaking the adherence of the mesh sheet to the surfaces of the wall around the hole, so that a concave mesh sheet portion is formed in the hole. After setting of the plaster layer, one applies a second portion of water hardenable cement material, to form a smooth wall surface over the hole and drywall patch.

The forming of the concave mesh sheet portion, prior to setting of the water hardenable cement material, helps in the subsequent "feathering out" of joint compound over the patch, making the process easier. Also, the concave portion helps to position the patch and to prevent it from moving or breaking loose as added portions of joint compound (or the like) are applied, to form the final, smooth wall surface for finishing up the hole patching project. The drywall patch is preferably initially flexible, before and after wetting of the water hardenable cement material, but when it hardens, it becomes a rigid member that is resistant to moving upon the application of lateral force, especially when the concave portion is formed, as described.

As stated previously, the hole that is patched may comprise a channel that has been cut in the drywall, for example for the insertion of lines or pipes. The patch material may be easily cut to shape from a roll in which it is provided, and applied to cover the channel. Preferably, the indentation step of the above method may also be applied in this circumstance.

As before, the mesh sheet may comprise Fiberglass of a commercially available type for wall patching, or an organic fiber fabric, and the dry adhesive and water hardenable cement product may also be of types that are commercially available. Thus, holes in drywall and similar wall materials may be covered by the patch of this invention, even though the hole is elongated in the form of a channel, or is of irregular shape.

The term "drywall" is intended to also include other appropriate walls and partitions, such as plaster walls and also ceilings.

DESCRIPTION OF SPECIFIC EMBODIMENTS

Figure 1:
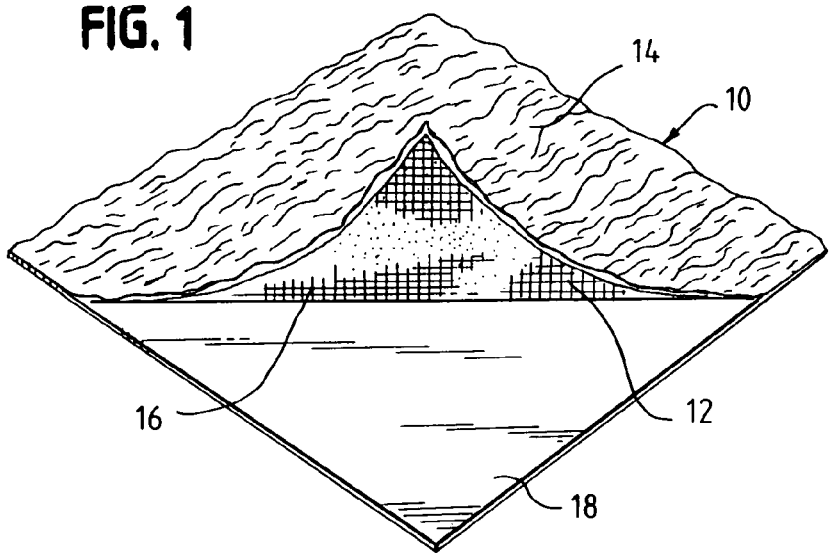
FIG. 1 is a perspective view of a square of the drywall repair patch material of this invention.

Referring to FIG. 1, a drywall repair patch is shown, cut into a twelve inch square of material. Drywall repair patch 10 comprises a mesh sheet of fiberglass similar to the type of fiberglass used in prior art drywall repair patches.

Fiberglass mesh sheet 12 carries primarily on an upper side, as shown in FIG. 1, a layer of flexible plaster 14, which may be similar to the plaster used in medical plaster bandages. On the other side 16 of mesh sheet 12, a layer of dry, pressure sensitive adhesive is provided, either placed on the crossing stands of mesh sheet 12 or as a layer over a second layer of flexible, bandage-type plaster on other side 16, which, in turn, adheres to mesh 12.

Finally, a conventional release sheet 18 is provided, adhering to the adhesive to protect the adhesive until use.

Figure 2:
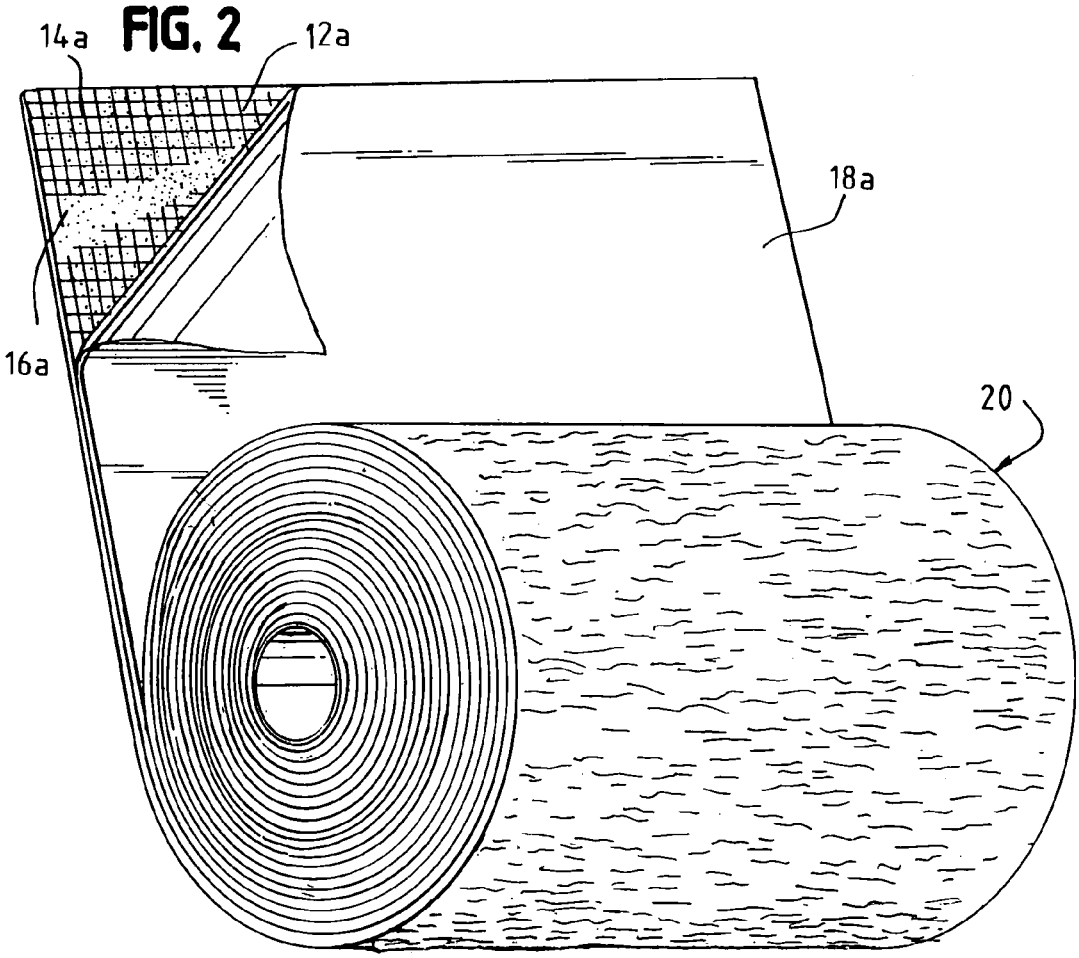
FIG. 2 is a perspective view of a roll of the drywall patch material of this invention.

Thus, as shown in FIG. 2, because of the flexibility of the uncured plaster layer or layers 14, the roll 20 of drywall repair patch material can be provided, comprising the preferably fiberglass mesh sheet 12*a*, carrying an outer layer of flexible plaster 14*a* and having a strip of release paper or plastic 18*a* overlying the dry, pressure sensitive adhesive 16*a*, with or without a second, intervening layer of water hardenable plaster between adhesive 16*a* and mesh sheet 12*a*.

The use of the repair patch of this invention is shown in FIGS. 3-7.

Figure 3:
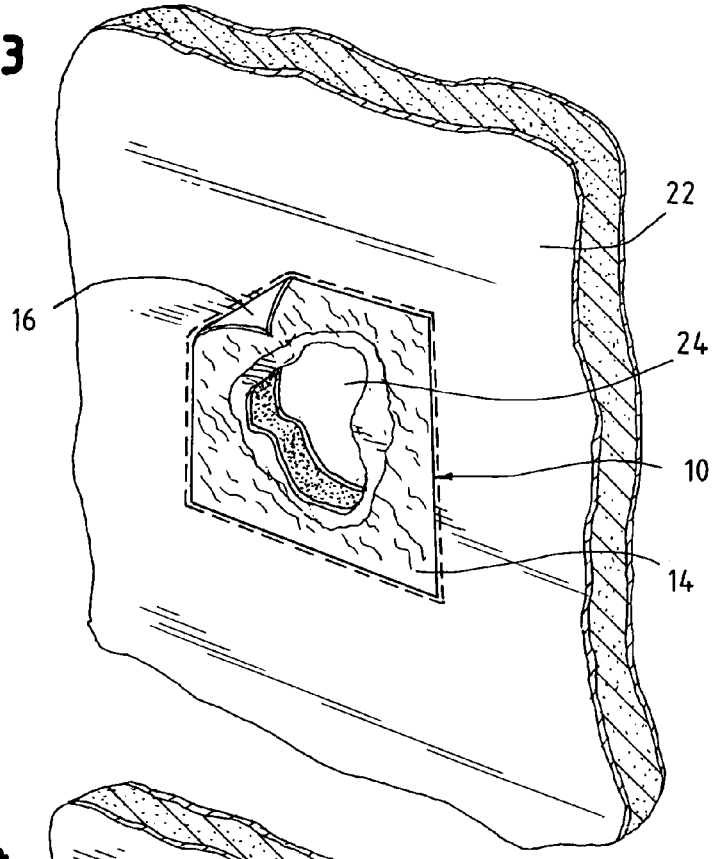
FIG. 3 is a perspective view, with portions broken away, showing the drywall patch material covering a hole in a section of drywall.

Turning to FIG. 3, a piece of vertical drywall 22 is shown having a hole 24 caused by damage, or alternatively intentionally created for access through the drywall. Patch 10 is shown being applied to overlie the hole 24 and to be attached to the drywall by dry adhesive layer 16. Backing layer 18 is of course removed prior to application of drywall patch 10. The central portion of drywall patch 10 has been removed to show the hole 24 that is being patched.

Figure 4:
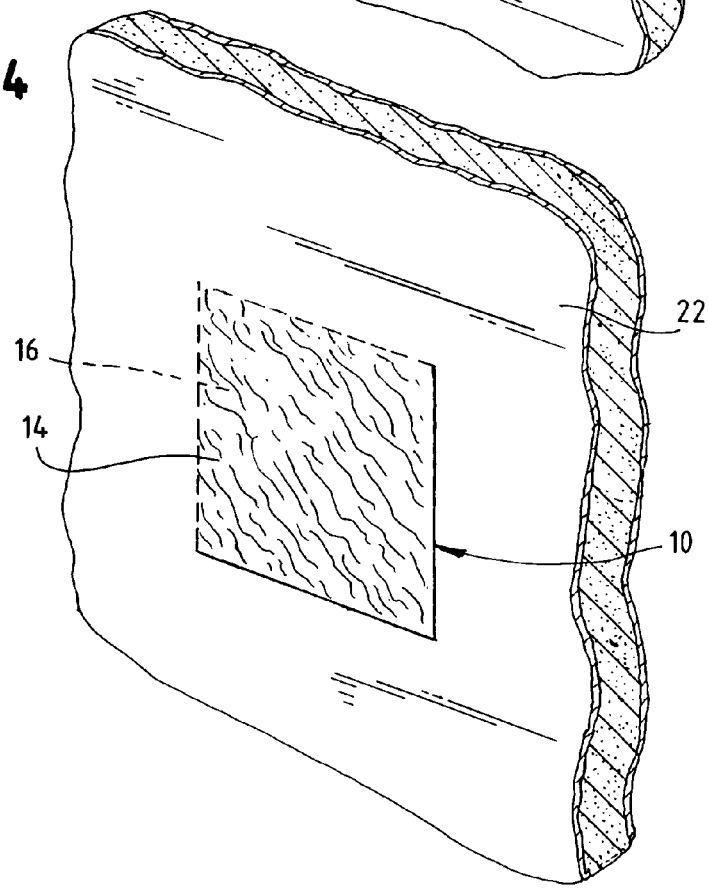
FIG. 4 is a perspective view of the drywall patch, applied as in FIG. 3, without any portion being broken away.

Turning to FIG. 4, drywall patch 10 is shown applied to drywall 22, making use of the dry adhesive layer 16, which secures drywall patch 10 to peripheral portions of the drywall around aperture 24, and with water hardenable plaster layer 14 facing outwardly.

Figure 5:
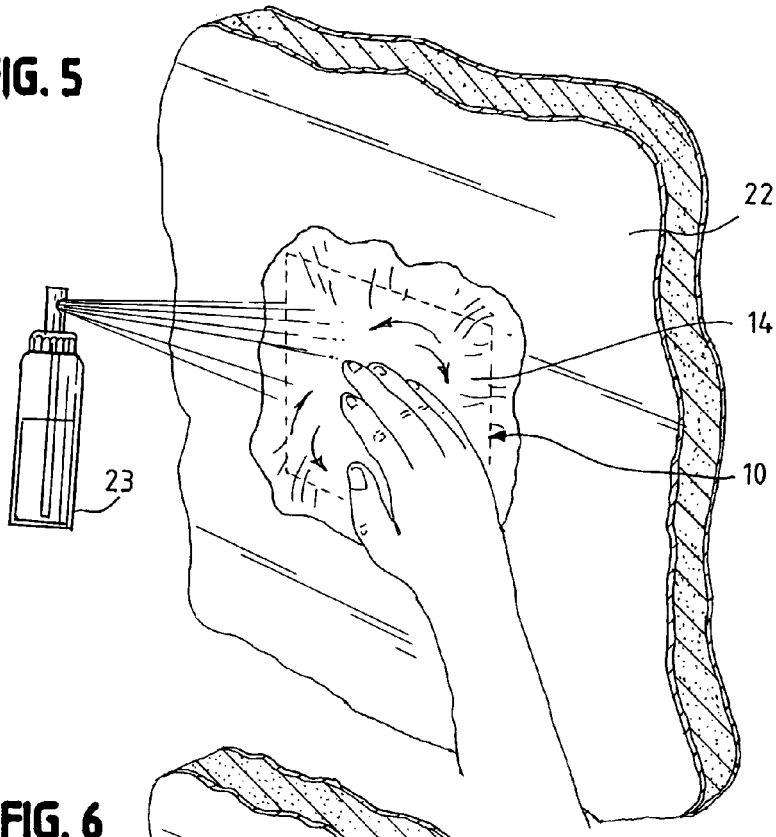
FIG. 5 shows how, in accordance with this invention, the drywall patch square of FIG. 4, after application to the wall using the dry adhesive, may have a water spray applied to activate and cure the water hardenable cement product.

Then, in FIG. 5, water is applied, typically in a spray form, to plaster layer 14 of the adhering drywall repair patch 10 on drywall 22, to moisten and soften the water hardenable plaster of layer 14, typically with gentle rubbing, spreading it outwardly a bit beyond patch 10.

Figure 6:
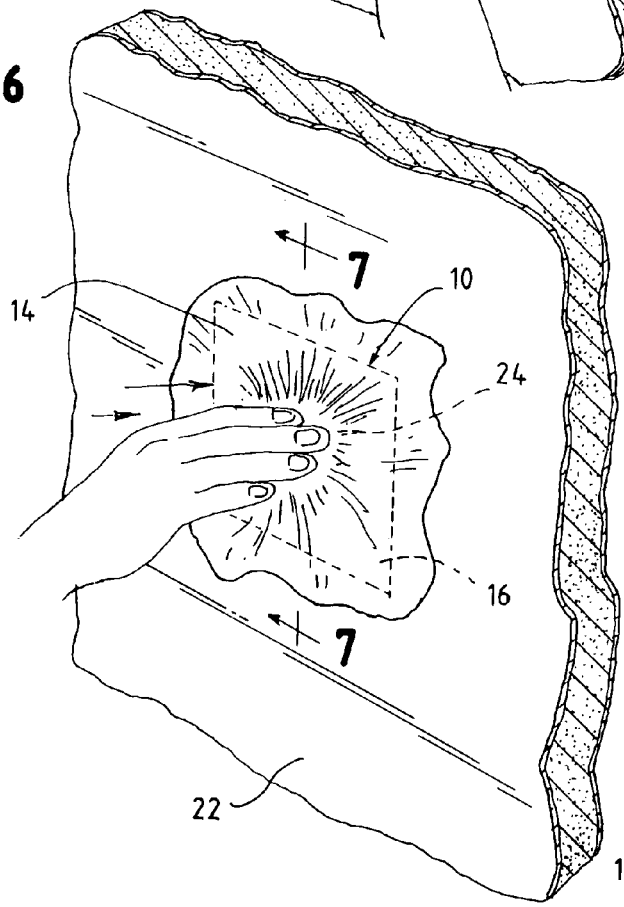
FIG. 6 is a perspective view showing how the patch, typically after treatment of FIG. 5, may be depressed in the center to form a concave indentation extending into the hole of the drywall, which indentation remains upon hardening of the cement product.
Figure 7:
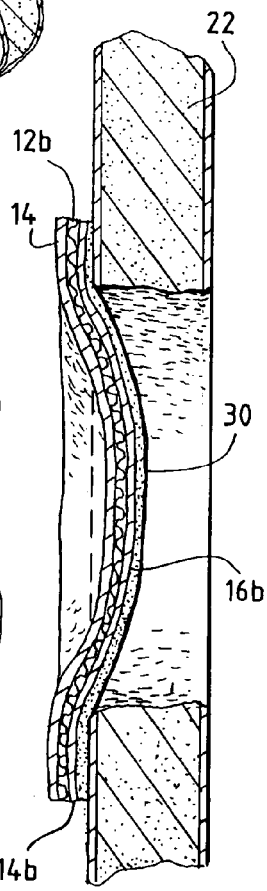
FIG. 7 is a sectional view taken along line 7-7 of FIG. 6.

Turning to FIG. 6, after the water hardenable plaster layer has been adequately hydrated by use of a water spray 23, it is preferred to manually press inwardly a central portion of drywall repair patch 10, preferably by at least about 5 mm at the deepest point, to form a concave portion or indentation 30 of the drywall patch that extends into hole 24, as particularly illustrated in FIG. 7. This is accomplished without substantially breaking the adherence of the mesh sheet 12, through adhesive layer 16, to the surfaces of drywall 22 around hole 24, by stretching of the central portion of drywall patch 10 and, as needed, some inward sliding of more peripheral portions of drywall patch 10, without breakage of the adhesive bond to the drywall.

Then, the drywall patch 10 is allowed to remain undisturbed until the hydrated plaster has set, causing drywall patch 10 to become rigid.

Because of the indentation 30, the installed, hardened drywall patch becomes more resistant to side forces that can cause it to separate, as a finishing layer of joint compound is applied to the wall patch in a conventional manner. This second portion of joint compound (or other water hardenable cement material) may often be more easily applied to form a smooth wall surface over the hole and the drywall patch because of indentation 30, to provide a professional looking repair. The presence of the concave recess 30 facilitates the application of a manually applied, added layer of water hardenable plaster, joint compound, or equivalent material, to form a smooth, essentially invisible wall surface over the hole and patch, using otherwise conventional plaster application techniques.

It should be noted that in FIG. 7, drywall patch 10 has been modified from its configuration in FIG. 1, to have a water hardenable cement material layer 14, 14*b* on each side of the mesh layer, and adhesive layer 16*b* is carried on layer 14*b*. This modified design may be used where additional amounts of plaster carried by the mesh sheet may be desired. However, the use of either design of drywall patch may be accomplished in the manner described above.

Figure 8:
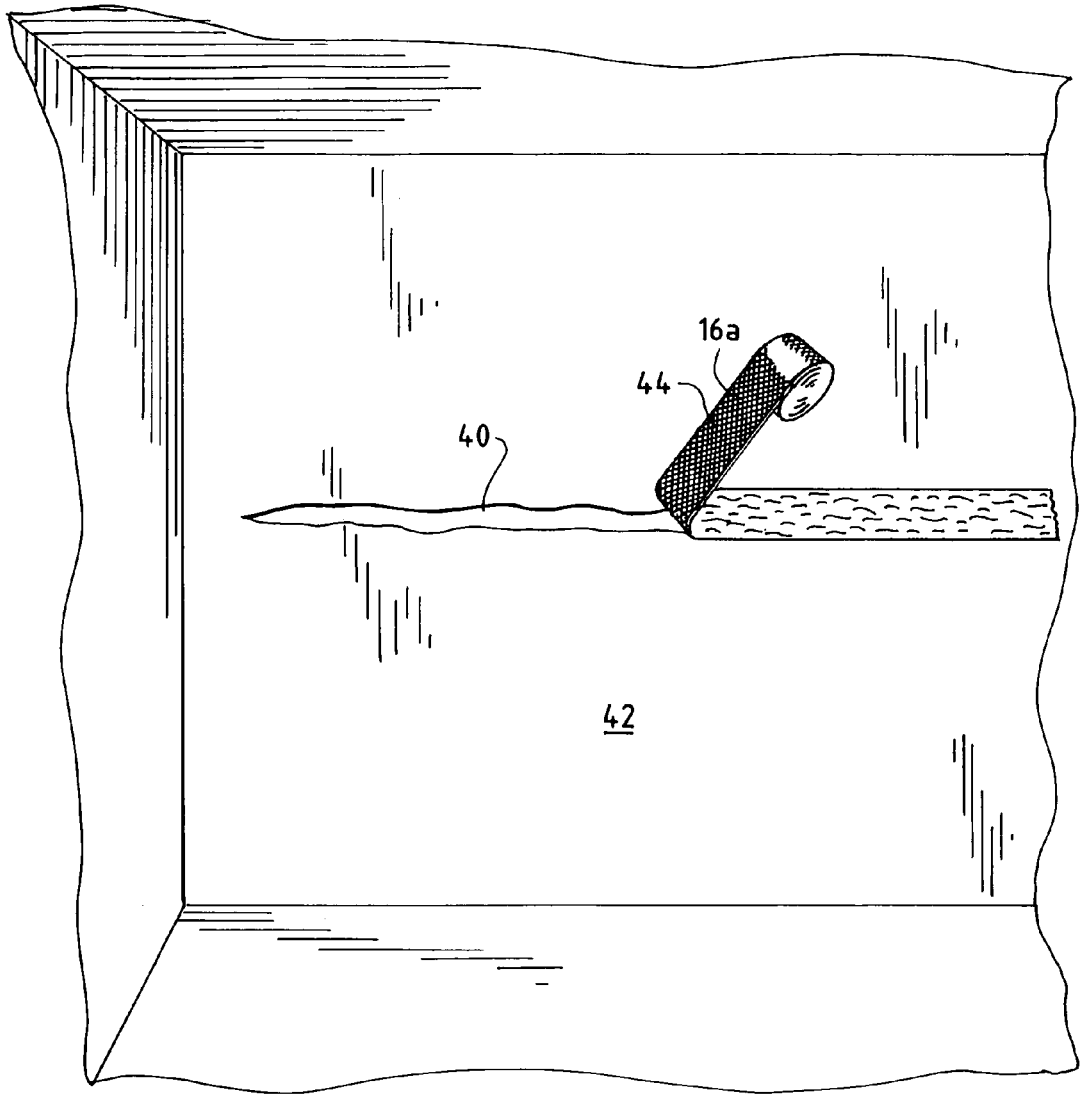
FIG. 8 is a perspective view of a channel in drywall being covered with a 6 inch wide strip of the patch of this invention.

Also, differently shaped segments of drywall patch material may be cut from the roll 20 of drywall patch material. For example, as in FIG. 8, a long channel 40 may have been cut through drywall 42 for the installation of a pipe or electric line. In that circumstance, the drywall patch 44, made as in FIG. 2, may comprise a long strip of material, which may be cut from the roll of FIG. 2, and applied over the channel 40, with the adhesive layer 16*a* adhering the drywall patch to the drywall material 42 that adjoins the cut channel. Then, the drywall patch may be hydrated as before, to wet plaster layer 14*a* and, preferably, an indented groove portion in the central part of the drywall patch strip may be pressed into channel 40. The drywall patch strip is then allowed to harden, prior to further application of joint compound or the like for finishing of the wall patching, thus achieving the advantages of this invention.

By this invention, a preferably flexible drywall patch can be applied to cover a hole in drywall while the patch is still in dry condition, making use of a dry, pressure sensitive adhesive layer 16, 16*a*, 16*b*. Then, a layer of water hardenable cement material, carried by the drywall patch mesh 12, 12*a*, 12*b*, may be hydrated and, preferably, indented into the hole being covered, to provide a patch, after it hardens, which stays in place more readily than the drywall patch systems of the prior art, permitting easier, subsequent application of wet joint compound or plaster over the patch and hole, to finish the project in a professional quality manner.

As another embodiment, a medical plaster bandage, sold by Johnson and Johnson for cast forming, was coated on one face with a contact adhesive, and adhered to drywall in a manner covering a hole in the drywall. Then the bandage, adhering to the drywall, was hydrated with a water spray, and a central portion thereof was pressed inwardly to create a concave portion of the bandage extending into the hole. After hardening of the plaster bandage, joint compound was easily applied, to hide the presence of the bandage patch.

The above has been offered for illustrative purposes only, and is not intended to limit the scope of the invention of this application, which is as defined in the claims below.

That which is claimed is:

1. A method of applying a drywall patch to a hole in drywall, which comprises:

applying over the hole a mesh sheet of said patch which carries an adhesive layer on at least one side thereof, to adhere the mesh sheet to surfaces around the hole and to cover the hole;

applying water to a layer of water hardenable cement product carried on the mesh sheet to obtain water permeation of said cement product;

pushing a central portion of the cement product layer and mesh sheet into the hole, without substantially breaking the adherence of the mesh sheet to the surfaces around the hole, to form a concave portion of said drywall patch in the hole; and after hardening of the water hardenable cement product, applying a second portion of water hardenable cementing material to form a smooth wall surface over the hole and drywall patch.

2. The method of claim 1 in which said hole comprises a channel cut in the drywall.

3. The method of claim 1 in which said mesh sheet comprises Fiberglass or cotton fabric.

4. The method of claim 1 in which said patch is cut from a roll comprising the material of said patch.

5. The method of claim 4 in which said mesh sheet comprises Fiberglass.

6. The method of claim 4 in which said hole is of an irregular shape.

7. The method of claim 4 in which said cement product comprises a bandage plaster.

8. The method of claim 1 in which said cement product comprises a bandage plaster.

9. The method of claim 1 wherein the adhesive is a dry adhesive.

10. The method of claim 1 wherein the drywall patch was previously part of a roll.

11. The method of claim 1 further comprising, before applying over the hole the mesh sheet of said patch:

applying the adhesive to one side of the mesh sheet.

12. The method of claim 1 further comprising, before applying over the hole the mesh sheet of said patch:

peeling a release sheet from the adhesive on the mesh sheet.

13. The method of claim 1 wherein pushing the central portion of the cement product layer comprises pushing the central portion with a finger.

14. The method of claim 1 wherein applying water to the water hardenable cement product comprises spraying water on the water hardenable cement product.

15. The method of claim 1 wherein the repair patch is at least about 4 inches in length and width.

16. The method of claim 1 wherein pushing the central portion of the cement product layer and mesh sheet includes pushing the central portion at least about 5 mm to form the concave portion.

17. The method of claim 1, wherein the hole has an edge; and wherein pushing the central portion of the cement product layer and mesh sheet into the hole, without substantially breaking the adherence of the mesh sheet to the surfaces around the hole, to form the concave portion of said drywall patch in the hole further includes contacting the patch to the edge of the hole to form the concave portion.

18. The method of claim 1, wherein the concave portion includes a substantially flat portion and a concave edge portion connecting to the substantially flat portion.

19. The method of claim 1, wherein pushing the central portion of the cement product layer and mesh sheet includes pushing the central portion at least about 5 mm to form the concave portion; and wherein the concave portion includes a substantially flat portion and a concave edge portion connecting to the substantially flat portion.

20. The method of claim 1, wherein the drywall patch is flexible before hardening of the water hardenable cement product.

21. The method of claim 1, wherein pushing the central portion of the cement product layer and mesh sheet into the hole, without substantially breaking the adherence of the mesh sheet to the surfaces around the hole, to form the concave portion of said drywall patch in the hole, wherein an upper surface the drywall patch is within the hole.

22. The method of claim 1, wherein the mesh sheet of the drywall patch carries the adhesive layer on a lower side and the layer of water hardenable cement product on an upper side.

23. A method of applying a drywall patch to a hole in drywall, which comprises:

peeling a release sheet from the adhesive on the mesh sheet;

applying over the hole a mesh sheet of said patch which carries an adhesive layer on at least one side thereof, to adhere the mesh sheet to surfaces around the hole and to cover the hole;

applying water to a layer of water hardenable cement product carried on the mesh sheet to obtain water permeation of said cement product;

pushing a central portion of the cement product layer and mesh sheet into the hole at least about 5 mm, without substantially breaking the adherence of the mesh sheet to the surfaces around the hole, to form a concave portion of said drywall patch in the hole; and after hardening of the water hardenable cement product, applying a second portion of water hardenable cementing material to form a smooth wall surface over the hole and drywall patch.

* * * * *